US011804683B2

(12) United States Patent
Barth et al.

(10) Patent No.: US 11,804,683 B2
(45) **Date of Patent: *Oct. 31, 2023**

(54) SNAP BUTTON FASTENER PROVIDING ELECTRICAL CONNECTION

(71) Applicant: Intel Corporation, Santa Clara, CA (US)

(72) Inventors: Hans-Joachim Barth, Munich (DE); Bastiaan Elshof, Regensburg (DE); Jan Proschwitz, Riesa (DE)

(73) Assignee: Intel Corporation, Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/751,080

(22) Filed: May 23, 2022

(65) Prior Publication Data

US 2022/0285898 A1 Sep. 8, 2022

Related U.S. Application Data

(63) Continuation of application No. 17/077,540, filed on Oct. 22, 2020, now Pat. No. 11,342,720, which is a (Continued)

(51) Int. Cl.
*H01R 33/00* (2006.01)
*A44B 17/00* (2006.01)

(Continued)

(52) U.S. Cl.
CPC ..... *H01R 33/00* (2013.01); *A41D 1/005* (2013.01); *A44B 17/0023* (2013.01);

(Continued)

(58) Field of Classification Search
CPC ..... H01R 33/00; H01R 4/64; H01R 13/627; H01R 13/6273; H01R 13/6277; A41D 1/005; A44B 17/0023; A44B 17/0064

(Continued)

(56) References Cited

U.S. PATENT DOCUMENTS 1,691,472 A 11/1928 Graham
3,085,577 A 4/1963 Berman (Continued)

FOREIGN PATENT DOCUMENTS

CN 102727182 10/2012
CN 103025230 4/2013

(Continued)

OTHER PUBLICATIONS

European Patent Office, "Summons to Attend Oral Proceedings Pursuant to Rule 115(1) EPC," issued in connection with European Appl. No. 20204081.2, dated Jan. 27, 2023, 4 pages.

(Continued)

*Primary Examiner* — Peter G Leigh
(74) *Attorney, Agent, or Firm* — HANLEY, FLIGHT & ZIMMERMAN, LLC

(57) ABSTRACT

Embodiments are generally directed to a snap button fastener providing electrical connection. An embodiment of a fastener includes a first mechanical part, the first mechanical part including at least a stud portion, the first mechanical part including a first electrical connector; a second mechanical part, the second mechanical part including at least a socket portion with a spring element and the socket portion, the second mechanical part including a second electrical connector. The stud portion of the first mechanical part and the socket portion of second mechanical part, if separated, are to interlock upon the application of a first force towards each other, and, if interlocked, to separate upon the application of a second force away from each other. The first electrical connector and the second electrical connector are to be electrically connected when the first mechanical part and the mechanical part are interlocked, and first electrical connector and the second electrical connector are to be (Continued)

disconnected when the first mechanical part and second mechanical part are separated.

28 Claims, 10 Drawing Sheets

Related U.S. Application Data continuation of application No. 16/259,640, filed on Jan. 28, 2019, now Pat. No. 10,886,680, which is a continuation of application No. 15/487,225, filed on Apr. 13, 2017, now Pat. No. 10,193,288, which is a continuation of application No. 14/578,187, filed on Dec. 19, 2014, now Pat. No. 9,627,804.

(51) Int. Cl.
*A41D 1/00* (2018.01)
*H01R 13/627* (2006.01)
*H01R 4/64* (2006.01)

(52) U.S. Cl.
CPC ..... *A44B 17/0064* (2013.01); *H01R 4/64* (2013.01); *H01R 13/627* (2013.01); *H01R 13/6273* (2013.01); *H01R 13/6277* (2013.01)

(58) Field of Classification Search
USPC ..... 439/578
See application file for complete search history.

(56) References Cited

U.S. PATENT DOCUMENTS 3,631,298 A 12/1971 Davis
3,793,610 A 2/1974 Brishka
3,973,418 A 8/1976 Close
4,000,547 A 1/1977 Eisenpresser
4,226,497 A 10/1980 Polonsky et al.
4,239,322 A 12/1980 Gordon, Jr.
4,402,560 A 9/1983 Swainbank
4,502,717 A 3/1985 Close
4,596,053 A 6/1986 Cohen et al.
4,753,615 A 6/1988 Weidler et al.
4,813,110 A 3/1989 Schiller
5,004,425 A 4/1991 Hee
5,018,044 A 5/1991 Weiss
5,099,228 A 3/1992 Israel et al.
5,102,727 A 4/1992 Pittman et al.
5,312,269 A 5/1994 Hwang
5,347,262 A 9/1994 Thurmond et al.
5,440,461 A * 8/1995 Nadel ..... F21V 19/0005 362/800
5,455,749 A * 10/1995 Ferber ..... A63F 9/001 362/800
5,565,840 A 10/1996 Thorner et al.
5,680,681 A 10/1997 Fuss
5,681,186 A 10/1997 Wright
5,960,537 A 10/1999 Vicich et al.
5,980,266 A 11/1999 Hsu
6,002,267 A 12/1999 Malhotra et al.
6,047,203 A 4/2000 Sackner et al.
6,210,771 B1 4/2001 Post et al.
6,255,950 B1 7/2001 Nguyen
6,350,129 B1 * 2/2002 Gorlick ..... H01R 13/187 439/8
6,381,482 B1 4/2002 Jayaraman et al.
6,478,633 B1 11/2002 Hwang
6,561,845 B2 5/2003 Ocheltree et al.
6,563,424 B1 * 5/2003 Kaario ..... G06F 1/163 340/572.1
6,687,523 B1 * 2/2004 Jayaramen ..... D03D 1/0088 600/534
6,729,025 B2 5/2004 Farrell et al.
6,854,988 B2 * 2/2005 Marmaropoulos .... A41D 1/005 361/679.02
6,956,614 B1 * 10/2005 Quintana ..... H04N 7/185 348/373
7,046,151 B2 5/2006 Dundon
7,049,626 B1 5/2006 Chen
7,144,830 B2 12/2006 Hill et al.
7,145,432 B2 12/2006 Lussey et al.
7,190,272 B2 3/2007 Yang et al.
7,210,939 B2 * 5/2007 Marmaropoulos .... H04R 5/023 2/905
7,367,811 B2 5/2008 Nagata
7,390,214 B2 6/2008 Tsiang
7,462,035 B2 * 12/2008 Lee ..... H01R 12/592 439/37
7,474,222 B2 1/2009 Yang et al.
7,514,641 B2 4/2009 Kohatsu et al.
7,536,884 B2 5/2009 Ho
7,556,532 B2 * 7/2009 Lee ..... H01R 13/625 439/620.22
7,609,503 B2 10/2009 Hee
7,724,146 B2 5/2010 Nguyen et al.
7,731,517 B2 * 6/2010 Lee ..... H01R 13/6277 439/271
7,821,403 B2 10/2010 Hogan et al.
7,825,346 B2 11/2010 Chu
7,872,557 B2 * 1/2011 Seibert ..... G06F 1/163 336/200
8,002,593 B2 8/2011 Machado et al.
8,186,231 B2 5/2012 Graumann et al.
8,259,460 B2 * 9/2012 Bhattacharya ..... H05K 3/301 361/767
8,308,489 B2 11/2012 Lee et al.
8,376,564 B2 2/2013 Finn
8,459,069 B2 6/2013 Garner
8,517,896 B2 * 8/2013 Robinette ..... A63B 24/00 702/160
8,552,847 B1 10/2013 Hill
8,911,240 B2 * 12/2014 Biddle ..... H05K 1/111 439/63
8,941,476 B2 1/2015 Hill
9,627,804 B2 4/2017 Barth et al.
9,693,592 B2 7/2017 Robinson et al.
9,754,464 B1 9/2017 Sinkov
9,758,907 B2 9/2017 Graumann et al.
9,799,177 B2 10/2017 Baron et al.
10,193,288 B2 1/2019 Barth et al.
10,238,150 B2 3/2019 Bremer
10,255,771 B2 4/2019 Baron et al.
10,613,248 B2 4/2020 Benke et al.
10,886,680 B2 1/2021 Barth et al.
11,342,720 B2 5/2022 Barth et al.
2001/0036785 A1 11/2001 Takagi et al.
2002/0005342 A1 1/2002 Farringdon
2002/0074937 A1 6/2002 Guberman et al.
2002/0076948 A1 6/2002 Farrell et al.
2002/0121146 A1 9/2002 Manaresi et al.
2002/0167483 A1 11/2002 Metcalf
2003/0119391 A1 6/2003 Swallow et al.
2004/0149481 A1 8/2004 Muller et al.
2004/0159131 A1 8/2004 Huehner
2005/0098421 A1 5/2005 Kohatsu et al.
2005/0113167 A1 5/2005 Buchner et al.
2006/0012944 A1 1/2006 Mamigonians
2006/0028430 A1 2/2006 Harary et al.
2007/0041600 A1 2/2007 Zachman
2007/0162156 A1 7/2007 Chu
2008/0006453 A1 1/2008 Hotelling
2009/0090305 A1 4/2009 Cheok et al.
2009/0149036 A1 6/2009 Lee et al.
2009/0149037 A1 6/2009 Lee et al.
2009/0248260 A1 10/2009 Flanagan
2009/0292192 A1 11/2009 Silber
2010/0100997 A1 4/2010 Lee et al.
2010/0112842 A1 5/2010 Machado et al.
2010/0139058 A1 * 6/2010 Pferdehirt ..... A44B 17/0023 24/697.1
2010/0271298 A1 10/2010 Vice et al.
2012/0215076 A1 8/2012 Yang et al.
2013/0247288 A1 9/2013 Kotos

(56) References Cited

U.S. PATENT DOCUMENTS

| | | | |
|---|---|---|---|
| 2014/0070957 | A1 | 3/2014 | Longinotti-Buitoni et al. |
| 2014/0142411 | A1 | 5/2014 | Lin et al. |
| 2014/0266607 | A1 | 9/2014 | Olodort |
| 2014/0302700 | A1 | 10/2014 | Makinen |
| 2014/0318699 | A1 | 10/2014 | Longinotti-Buitoni et al. |
| 2015/0185884 | A1 | 7/2015 | Magi |
| 2016/0224115 | A1 | 8/2016 | Olien et al. |
| 2016/0366557 | A1 | 12/2016 | Gallegos et al. |
| 2017/0098353 | A1 | 4/2017 | Ekambaram et al. |
| 2017/0178471 | A1 | 6/2017 | Levesque et al. |
| 2017/0196513 | A1 | 7/2017 | Longinotti-Buitoni et al. |
| 2017/0249810 | A1 | 8/2017 | Zerick et al. |
| 2017/0319132 | A1 | 11/2017 | Longinotti-Buitoni et al. |
| 2017/0325518 | A1 | 11/2017 | Poupyrev et al. |
| 2018/0160940 | A1 | 6/2018 | Kim et al. |
| 2018/0187347 | A1 | 7/2018 | Graumann et al. |
| 2019/0030411 | A1 | 1/2019 | Yang et al. |
| 2019/0132948 | A1 | 5/2019 | Longinotti-Buitoni et al. |
| 2019/0304268 | A1 | 10/2019 | Baron et al. |
| 2019/0393659 | A1 | 12/2019 | Barth et al. |
| 2020/0064141 | A1 | 2/2020 | Bell et al. |
| 2020/0204177 | A1 | 6/2020 | Cobanoglu et al. |
| 2021/0044065 | A1 | 2/2021 | Barth et al. |

FOREIGN PATENT DOCUMENTS

| | | | |
|---|---|---|---|
| CN | 103247901 | | 8/2013 |
| EP | 2757639 | | 7/2014 |
| GB | 2427240 | | 12/2006 |
| JP | 2003077566 | | 3/2003 |
| JP | 3098323 | | 2/2004 |
| JP | 2006346421 | | 12/2006 |
| JP | 2008536529 | | 9/2008 |
| JP | 3179980 | | 11/2012 |
| JP | 2013158353 | | 8/2013 |
| JP | 2013158353 | A | 8/2013 |
| JP | 2014110866 | | 6/2014 |
| JP | 2018500066 | | 1/2018 |
| KR | 1020110009966 | | 1/2011 |
| KR | 101203912 | | 11/2012 |
| TW | 200810033 | | 2/2008 |
| WO | 0115286 | A1 | 3/2001 |
| WO | 2006079888 | | 8/2006 |
| WO | 2010033902 | A2 | 3/2010 |
| WO | 2010033902 | A3 | 3/2010 |

OTHER PUBLICATIONS

China National Intellectual Property Administration, "First Search," issued in connection with Chinese Appl. No. 2020112271122, dated Jan. 21, 2022, 2 pages.

China National Intellectual Property Administration, "First Office Action," issued in connection with Chinese Appl. No. 202011227112.2, dated Jan. 30, 2022, 7 pages. (English translation included).

The United States Patent and Trademark Office, "Non-Final Office Action", issued in connection with U.S. Appl. No. 14/578,187 dated Dec. 18, 2015, 19 pages.

The United States Patent and Trademark Office, "Final Office Action", issued in connection with U.S. Appl. No. 14/578,187 dated Jul. 12, 2016, 13 pages.

The United States Patent and Trademark Office, "Notice of Allowance and Fee(s) Due", issued in connection with U.S. Appl. No. 14/578,187 dated Dec. 14, 2016, 8 pages.

Taiwan Patent Office, "Office Action and Search Report", issued in connection with application No. 104138089 dated Jan. 24, 2017, with machine translation, 25 pages.

International Searching Authority, "International Search Report and Written Opinion", issued in connection with PCT/US2015/058073 dated Feb. 2, 2016, 10 pages.

European Patent Office, "Extended European Search Report", issued in connection with application No. 15870531.9 dated May 29, 2018, 8 pages.

National Intellectual Property Administration, "First Office Action", issued in connection with application No. 201580061762.5 dated Nov. 2, 2018, 10 pages.

The United States Patent and Trademark Office, "Non-Final Office Action", issued in connection with U.S. Appl. No. 15/487,225 dated Oct. 5, 2017, 12 pages.

The United States Patent and Trademark Office, "Notice of Allowance and Fee(s) Due", issued in connection with U.S. Appl. No. 15/487,225 dated Sep. 13, 2018, 10 pages.

National Intellectual Property Administration, "Second Office Action", issued in connection with application No. 201580061762.5 dated Apr. 15, 2019, 7 pages.

Japanese Patent Office, "Notice of Reasons for Refusal", issued in connection with application No. 2017-527202 dated Aug. 8, 2019, with translation, 13 pages.

The State Intellectual Property Office of People's Republic of China, "Third Office Action", issued in connection with application No. 201580061762.5 dated Dec. 4, 2019, 20 pages.

European Patent Office, "Invitation Pursuant to Rule 137(4) EPC and Article 94(3) EPC", issued in connection with application No. 15870531.9 dated Jan. 29, 2020, 2 pages.

Japanese Patent Office, "Decision of Refusal", issued in connection with application No. 2017-527202 dated Feb. 12, 2020, machine translation included, 9 pages.

China National Intellectual Property Administration, "Decision on Rejection", issued in connection with application No. 201580061762.5 dated Apr. 16, 2020, translation included, 14 pages.

International Searching Authority, "International Search Report and Written Opinion" issued in connection with Application No. PCT/US2009/057660, dated Apr. 20, 2010, 6 pages.

Patent Cooperation Treaty, "International Preliminary Report on Patentability", issued in connection with Application No. PCT/US2009/057660, dated Mar. 22, 2011, 4 pages.

United States Patent and Trademark Office, "Non-Final Office Action", issued in connection with U.S. Appl. No. 12/284,440 dated Sep. 29, 2010, 9 pages.

United States Patent and Trademark Office, "Final Office Action", issued in connection with U.S. Appl. No. 12/284,440 dated Mar. 30, 2011, 7 pages.

United States Patent and Trademark Office, "Non-Final Office Action", issued in connection with U.S. Appl. No. 12/284,440 dated Aug. 22, 2012, 7 pages.

United States Patent and Trademark Office, "Non-Final Office Action", issued in connection with U.S. Appl. No. 12/284,440 dated Apr. 12, 2013, 6 pages.

United States Patent and Trademark Office, "Patent Board Decision", issued in connection with U.S. Appl. No. 12/284,440 dated Apr. 5, 2017, 6 pages.

United States Patent and Trademark Office, "Non-Final Office Action", issued in connection with U.S. Appl. No. 12/284,440 dated Oct. 24, 2013, 5 pages.

United States Patent and Trademark Office, "Final Office Action", issued in connection with U.S. Appl. No. 12/284,440 dated Apr. 10, 2014, 7 pages.

United States Patent and Trademark Office, "Notice of Allowance", issued in connection with U.S. Appl. No. 15/702,336 dated May 1, 2017, 7 pages.

United States Patent and Trademark Office, "Non-Final Office Action", issued in connection with U.S. Appl. No. 15/702,336 dated Sep. 19, 2019, 7 pages.

United States Patent and Trademark Office, "Final Office Action", issued in connection with U.S. Appl. No. 15/702,336 dated Apr. 6, 2020, 8 pages.

United States Patent and Trademark Office, "Non-Final Office Action", issued in connection with U.S. Appl. No. 16/378,175 dated Dec. 12, 2019, 6 pages.

Google.com, "About Jacquard by Google", retrieved from https://atap.google.com/jacquard/products/ on Jul. 9, 2020, 17 pages.

Levi's, "Introducing Levi's Commuter Trucker Jacket with Jacquard by Google", published on Sep. 25, 2017, retrieved from https://www.youtube.com/watch?v=G9ADVeNpypk on Jul. 9, 2020, 1 page.

(56) References Cited

OTHER PUBLICATIONS

Poupyrev, Ivan, "More Than Just a Jacket: Levi's Commuter Trucker Jacket Powered by Jacquard Technology", retrieved from https://www.blog.google/products/atap/more-just-jacket-levis-commuter-trucker-jacket-powered-jacquard-technology/ on Jul. 9, 2020, 5 pages.
Google.com, "Meet the Jacquard App", retrieved from https://support.google.com/jacquard/answer/7517020?hl=en on Jul. 9, 2020, 2 pages.
Google.com, "Your Jacquard Tag", retrieved from https://support.google.com/jacquard/answer/7515550?hl=en on Jul. 9, 2020, 3 pages.
Google.com, "Jacquard Gestures", retrieved from https://support.google.com/jacquard/answer/7537511?hl=en#:~:text=Next-,Jacquard%20gestures,%2C%20answer%20calls%2C%20and%20more. on Jul. 9, 2020, 4 pages.
Google.com, "Jacquard Light States and Alerts", retrieved from https://support.google.com/jacquard/answer/7503841?hl=en on Jul. 8, 2020, 2 pages.
"Immersion, Touch Technology—Made for the Digital World",retrieved from https://www.immersion.com/ on Jul. 9, 2020, 6 pages.
"Immersion Announces that the Fujitsu Arrows NX F-04G is the Latest Smartphone to Launch with Immersion's Haptic Technology", retrieved from https://www.businesswire.com/news/home/20150722005462/en/Immersion-Announces-Fujitsu-ARROWS-NX-F-04G-Latest on Jul. 9, 2020, 3 pages.
Conway, Adam, "Levi's Commuter Trucker Jacket Now Available, Powered by Google's Jacquard Smart Clothing Platform", published on Sep. 25, 2017, retrieved from https://www.xda-developers.com/levis-commuter-trucker-jacket-smart/ on Jul. 8, 2020, 6 pages.
United States Patent and Trademark Office, "Non-Final Office Action", issued in connection with U.S. Appl. No. 15/792,194 dated Jun. 15, 2018, 5 pages.
United States Patent and Trademark Office, "Notice of Allowance", issued in connection with U.S. Appl. No. 15/792,194 dated Nov. 28, 2018, 6 pages.
United States Patent and Trademark Office, "Non-Final Office Action", issued in connection with U.S. Appl. No. 14/494,407 dated Sep. 9, 2016, 7 pages.
United States Patent and Trademark Office, "Final Office Action", issued in connection with U.S. Appl. No. 14/494,407 dated Mar. 23, 2017, 5 pages.
United States Patent and Trademark Office, "Notice of Allowance", issued in connection with U.S. Appl. No. 14/494,407 dated Jun. 27, 2017, 7 pages.
"About Jacquard, Connectivity Woven Into Everyday Essentials", retrieved from https://atap.google.com/jacquard/about/ retrieved Jan. 15, 2018, 6 pages.
"Meet the Jacquard App", retrieved from on https://support.google.com/jacquard/answer/7517020?hl=en&ref_topic=7516860 on Jan. 15, 2018, 1 page.
Meet the Jacquard app—See your threads—Touch your cuff, retrieved from https://support.google.com/jacquard/answer/7517020?hl=en &ref topic+ 75 on Sep. 17, 2018, 3 pages.
"Immersion, Touch Technology—made for the digital world", retrieved from www.immersion.com on Sep. 13, 2018, 6 pages.
"Wearable Tech, Crunchwear, Wearable Technology & Smart Clothes News", retrieved from www.crunchwear.com on Sep. 13, 2018, 4 pages.
European Patent Office, "Communication Pursuant to Article 94(3) EPC", issued in connection with application No. 15870531.9 dated Sep. 30, 2020, 4 pages.
Patent Cooperation Treaty, "International Preliminary Report on Patentability," issued in connection with Application No. PCT/US2015/058073, dated Jun. 29, 2017, 9 pages.
The United States Patent and Trademark Office, "Corrected Notice of Allowability", issued in connection with U.S. Appl. No. 14/578,187 dated Mar. 8, 2017, 2 pages.
The United States Patent and Trademark Office, "Non-Final Office Action", issued in connection with U.S. Appl. No. 16/259,640 dated Oct. 24, 2019, 9 pages.
The United States Patent and Trademark Office, "Corrected Notice of Allowability", issued in connection with U.S. Appl. No. 16/259,640 dated Jun. 29, 2020, 2 pages.
The United States Patent and Trademark Office, "Notice of Allowance", issued in connection with U.S. Appl. No. 16/259,640 dated Jul. 27, 2020, 8 pages.
The United States Patent and Trademark Office, "Notice of Allowance", issued in connection with U.S. Appl. No. 16/259,640 dated Apr. 13, 2020, 8 pages.
United States Patent and Trademark Office, "Supplementary Notice of Allowability", issued in connection with U.S. Appl. No. 15/792,194 dated Jan. 3, 2019, 2 pages.
The United States Patent and Trademark Office, "Non-Final Office Action", issued in connection with U.S. Appl. No. 16/378,175 dated Aug. 7, 2020, 9 pages.
European Patent Office, "Extended European Search Report", issued in connection with Application No. 20204081.2 on Feb. 12, 2021, 7 pages.
"Jacquard LED Light States and Notifications," retrieved from https://support.google.com/jacquard/answer/750384?hl=en on Jan. 22, 2018, 1 page.
"Jacquard Gestures," retrieved from https://support.google.com/jacquard/answer/7537511?hl=en&ref_topic_751678- 0 on Sep. 17, 2018, 3 pages.
"Jacquard Snap Tag," retrieved from https://support.google.com/jacquard/answer/7515550?hl=en&ref_topic_7382578 on Jan. 16, 2018, 3 pages.
"Introducing Levi's Commuter Trucker Jacket with Jacquard by Google," published Sep. 25, 2017, retrieved from www.youtube.com, 1 page.
Conway, Adam, "Levi's Commuter Trucker Jacket Now Available, Powered by Google's Jacquard Smart Clothing Platform", published on Sep. 25, 2017, retrieved from https://www.xda-developers.com/levis-commuter-trucker-jacket-smart/ on Jul. 9, 2020, 6 pages.
The United States Patent and Trademark Office, "Final Office Action", issued in connection with U.S. Appl. No. 16/378,175 dated Dec. 31, 2020, 13 pages.
United States Patent and Trademark Office, "Advisory Action," issued in connection with U.S. Appl. No. 16/378,175, dated May 10, 2021, 4 pages.
United States Patent and Trademark Office, "Non-Final Office Action," issued in connection with U.S. Appl. No. 16/378,175, dated Aug. 19, 2021, 22 pages.
China National Intellectual Property Administration, "Decision on Reexamination," issued in connection with Chinese Application No. 201580061762.5, dated May 8, 2021, 20 pages.
European Patent Office, "Examination Report" issued in connection with European Application No. 15870531.9 dated Dec. 2, 2021, 41 pages.
European Patent Office, "Examination Report" issued in connection with European Application No. 20204081.2 dated Dec. 2, 2021, 4 pages.
Korean Patent Office, "Notice of Preliminary Rejection" issued in connection with Korean Application No. 2017 7013514 dated May 23, 2022, 19 pages.
Korean Patent Office, "Notice of Preliminary Rejection" issued in connection with Korean Application No. 2017 7013514 dated Nov. 29, 2022, 14 pages.
China National Intellectual Property Administration, "Decision on Rejection," issued in connection with Chinese Application No. 202011227112.2, dated Oct. 10, 2022, 10 pages.
United States Patent and Trademark Office, "Notice of Allowance," issued in connection with U.S. Appl. No. 17/077,540, dated Jan. 21, 2022, 6 pages.
United States Patent and Trademark Office, "Corrected Notice of Allowability," issued in connection with U.S. Appl. No. 17/077,540, dated Mar. 3, 2022, 6 pages.
United States Patent and Trademark Office, "Notice of Allowance and Fee(s) Due," issued in connection with U.S. Appl. No. 16/378,175, dated Apr. 27, 2022, 6 pages.
Korean Intellectual Property Office, "Notice of Final Rejection," issued in connection with Korean Patent Application No. 10-2017-7013514, dated Jun. 27, 2023, 6 pages.

(56) References Cited

OTHER PUBLICATIONS

European Patent Office, "Communication pursuant to Article 94(3) EPC" issued in connection with Application No. 15870531.9, dated Aug. 29, 2023, 4 pages.

* cited by examiner

SNAP BUTTON FASTENER PROVIDING ELECTRICAL CONNECTION

RELATED APPLICATIONS

This patent arises from a continuation of U.S. application Ser. No. 17/077,540 (now U.S. Pat. No. 11,342,720), titled "Snap Button Fastener Providing Electrical Connection," filed Oct. 22, 2020, which is a continuation of U.S. application Ser. No. 16/259,640 (now U.S. Pat. No. 10,886,680), titled "Snap Button Fastener Providing Electrical Connection," filed Jan. 28, 2019, which is a continuation of U.S. application Ser. No. 15/487,225 (now U.S. Pat. No. 10,193,288), titled "Snap Button Fastener Providing Electrical Connection," filed Apr. 13, 2017, which is a continuation of U.S. application Ser. No. 14/578,187 (now U.S. Pat. No. 9,627,804), titled "Snap Button Fastener Providing Electrical Connection," filed Dec. 19, 2014. U.S. application Ser. No. 17/077,540; U.S. application Ser. No. 16/259,640; U.S. application Ser. No. 15/487,225; and U.S. application Ser. No. 14/578,187 are incorporated herein by this reference in their entireties.

TECHNICAL FIELD

Embodiments described herein generally relate to the field of electrical devices and, more particularly, to a snap button fastener providing electrical connection.

BACKGROUND

Manufacturers are increasingly designing and marketing wearable electronics, in which electronic devices are contained within or operate in conjunction with wearable items, where the wearable items may include items of clothing.

In some cases, the electronics are embedded within the wearable item, and thus may require a power source, processing ability, and sensing operation that is integrated within the wearable item.

In the use and operation of wearable electronics, there may be instances in which the electronics are susceptible to damage. For instance, the normal care of clothing may be damaging to embedded electronics. In a particular example, the washing or other cleaning of clothing items may damage or destroy embedded electronics.

BRIEF DESCRIPTION OF THE DRAWINGS

Embodiments described here are illustrated by way of example, and not by way of limitation, in the figures of the accompanying drawings in which like reference numerals refer to similar elements.

DETAILED DESCRIPTION

Figure 1:
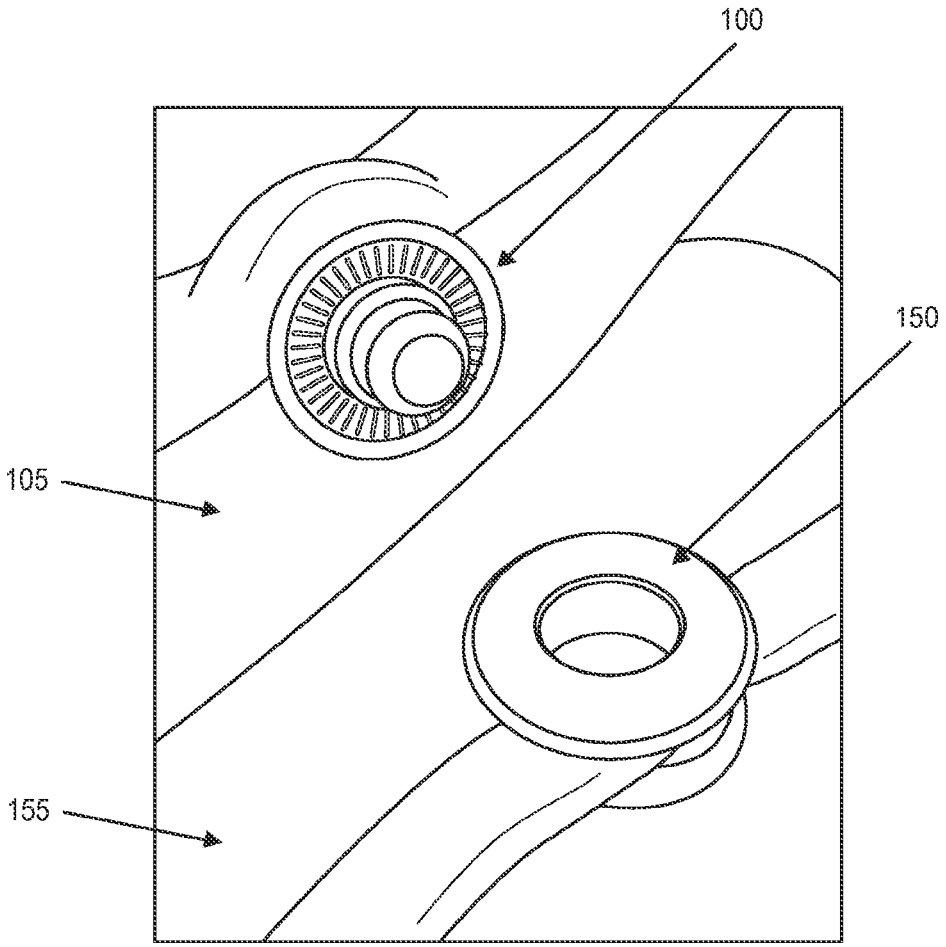
FIG. 1 is an illustration of a snap button fastener.

Embodiments described herein are generally directed to a snap button fastener providing electrical connection.

For the purposes of this description:

"Snap button" refers to a mechanical fastener including a first mechanical part including a stud portion and a second mechanical part including a socket portion, the first mechanical part and second mechanical part being constructed to connect ("snap") together with the application of a certain force pushing the first and second mechanical parts together, and separate upon the application of a certain force pulling the first and second mechanical parts away from each other. The first mechanical part and the second mechanical part may be in the form of removably interlocking disks, but may have other shapes as well. A snap button may also be referred to as a snap fastener, a snap, or other terms.

"Wearable electronics" means an electronic device that is integrated at least in part into an item that may be worn by a user. Wearable electronics may include electronic devices that operate independently as well as electronic devices that operate in conjunction with a second electronic device, such as a mobile device.

"Mobile device" means a smartphone, smartwatch, tablet computer, handheld computer, mobile Internet device, or other mobile apparatus that includes processing ability and communication ability.

Wearable electronics may include one or more electronic elements that are embedded in a wearable item such as an item of clothing. In one example, certain electronics may be embedded in a jacket or other similar item.

However, the use and care of a wearable item may damage or destroy embedded electronics. For example, if the item requires washing or other cleaning, the electronics may be damaged in the washing or cleaning process. Further, the one or more portions of the electronics may need to be removed for recharging, replacement, repair, or other operation. However, the removal and replacement of electronics may be impractical or inconvenient for a user.

In some embodiments, a snap button fastener providing an electrical connection is provided. In some embodiments, the snap button includes a first mechanical part having a first electrical connector and a second mechanical device having a second electrical connector. In some embodiments, upon the first mechanical part being interlocked with the second mechanical part, the first electrical connector is electrically connected with the second electrical connector, and upon the first mechanical part being separated from the second mechanical part, the first electrical connector is disconnected from the second electrical connector. In some embodiments, the electrical connector is at least in part within the mechanical part, and in some embodiments the electrical connector and mechanical part are a single part.

In some embodiments, a wearable electronics item includes one or more snap button fasteners providing electrical connections to allow a user of the wearable electronics to easily and naturally connect and disconnect one or more elements of the wearable electronics. In some embodiments, the one or more elements may also be removed from a first wearable item and connected to a different wearable item, with the snap buttons allowing a user to easily transfer electronics between garments.

FIG. 1 is an illustration of a snap button fastener. There are a wide variety of different snap buttons available for conventional garments. A typical example is illustrated in FIG. 1, where the snap button fastener includes a first mechanical part 100 of the snap button, which may be referred as the male part, in a first portion 105 of a wearable element (such as in a first portion of fabric, leather, or other material) and a second mechanical part 150 of the snap button, which may be referred to as the female part, in a second portion 155 of the wearable element (such as in a first portion of fabric or other material).

The first mechanical part 100 includes a stud portion and the second mechanical part 150 includes a socket portion including a spring element, the spring element being an s-spring (providing a parallel spring element in the socket), a ring spring (split ring to provide a spring function), or other physical feature providing a spring force to engage the stud portion and interlock the portions of the snap button together after sufficient force has been applied to allow the stud portion to be inserted in the socket portion, thus snapping the first mechanical part and the second mechanical part together. The first mechanical part 100 and the second mechanical part may be separated by providing a sufficient opposite force to overcome the force of the spring element of the second mechanical part. However, this is a particular example of a snap button, and other designs of snap buttons may include variations in structure and use.

In some embodiments, the first mechanical part 100 and the second mechanical part 150 further provide an electrical connection, wherein the snapping of the first mechanical part 100 into the second mechanical part 150 operates to make the electrical connection (create a closed connection), and separation of the first mechanical part and the second mechanical part operates to break the electrical connection (create an open connection).

Figure 2:
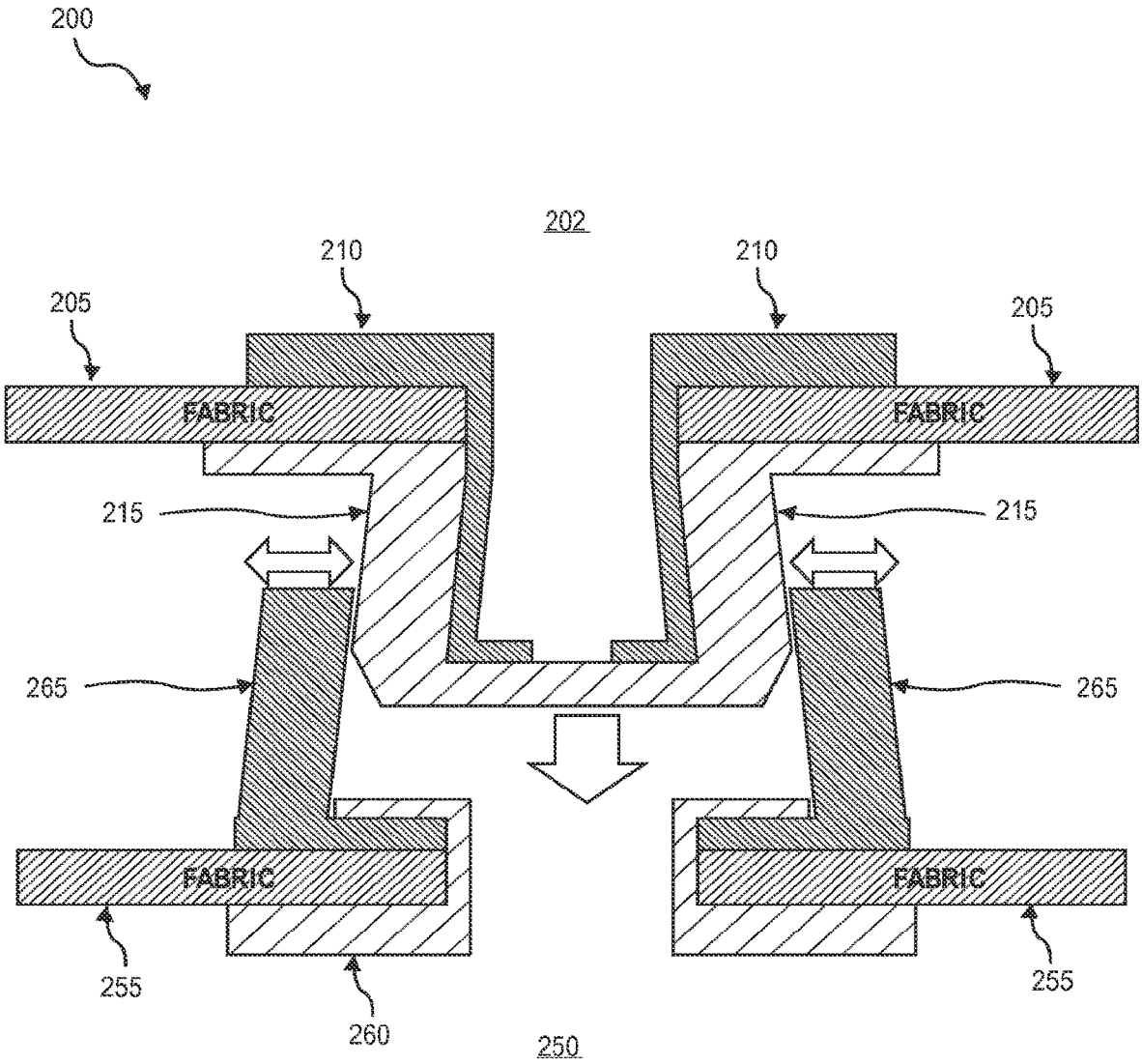
FIG. 2 is an illustration of components of a snap button fastener.

FIG. 2 is an illustration of components of a snap button fastener. In conventional use, the snap button may be utilized to hold two portions of fabric or other material together using a mechanical or other force when the two parts of the snap button are mated together and to allow separation of the two portions of fabric or other material when the two parts of the snap button are separated.

As illustrated in the cross-section provided in FIG. 2, a snap button 200 may include a first mechanical part (male part) 202 to be snapped into a second mechanical part (female part) 250. The first mechanical part 202 may be installed in a first portion of fabric or other material 205. The first mechanical part 202 and second mechanical part 250 are commonly circular along an axis perpendicular to the fabric, thus including a disc shape, but this is not required in all implementations.

In the illustrated example, the first mechanical part 202 of the snap button 200 may include multiple sub-parts that are installed together to form the first mechanical part, such as, for example, a first sub-part 210 that forms a surface on one side of the fabric 205 and extends through a hole in the fabric 205 and a second sub-part 215 that encloses the portion of the first sub-part 210 that extends through the fabric and forms the stud shape of the first mechanical part 202. As can be seen from the cross-section of the snap button 200, the second sub-part 215 has at least a portion with an angle such that the plug shape is larger further away from the fabric that the plug shape is nearer to the fabric.

In the illustrated example, the second mechanical part 250 of the snap button 200 may include multiple sub-parts that are installed together to form the second mechanical part, such as, for example, a first sub-part 260 that forms a surface on one side of the fabric 255 and extends through a hole in the fabric 255 and clamps at least part of a second sub-part 265 that forms the socket shape of the first second mechanical part 250. At least a part of the second sub-part 265 provides a spring element to be displaced when the stud shape of the first mechanical part 202 is inserted in the socket portion of the second mechanical part and to provide mechanical force to hold the first and second mechanical parts together under a sufficient force along the axis is applied to separate the first and second mechanical part. As can be seen from the cross-section of the snap button 200, the second sub-part 265 has at least a portion with an angle such that the socket shape is smaller further away from the fabric than the receptacle shape is near to the fabric in order to hold the first mechanical part 202 in place when snapped together.

In some embodiments, the first mechanical part 202 and the second mechanical part 250 further provide an electrical connection, wherein the snapping of the first mechanical part 202 into the second mechanical part 250 operates to make the electrical connection, and separation of the first mechanical part and the second mechanical part operates to break the electrical connection. In some embodiments, the spring element of the snap button 200 serves to maintain the electrical connection until the mechanical parts of the snap button are separated.

Figure 3:
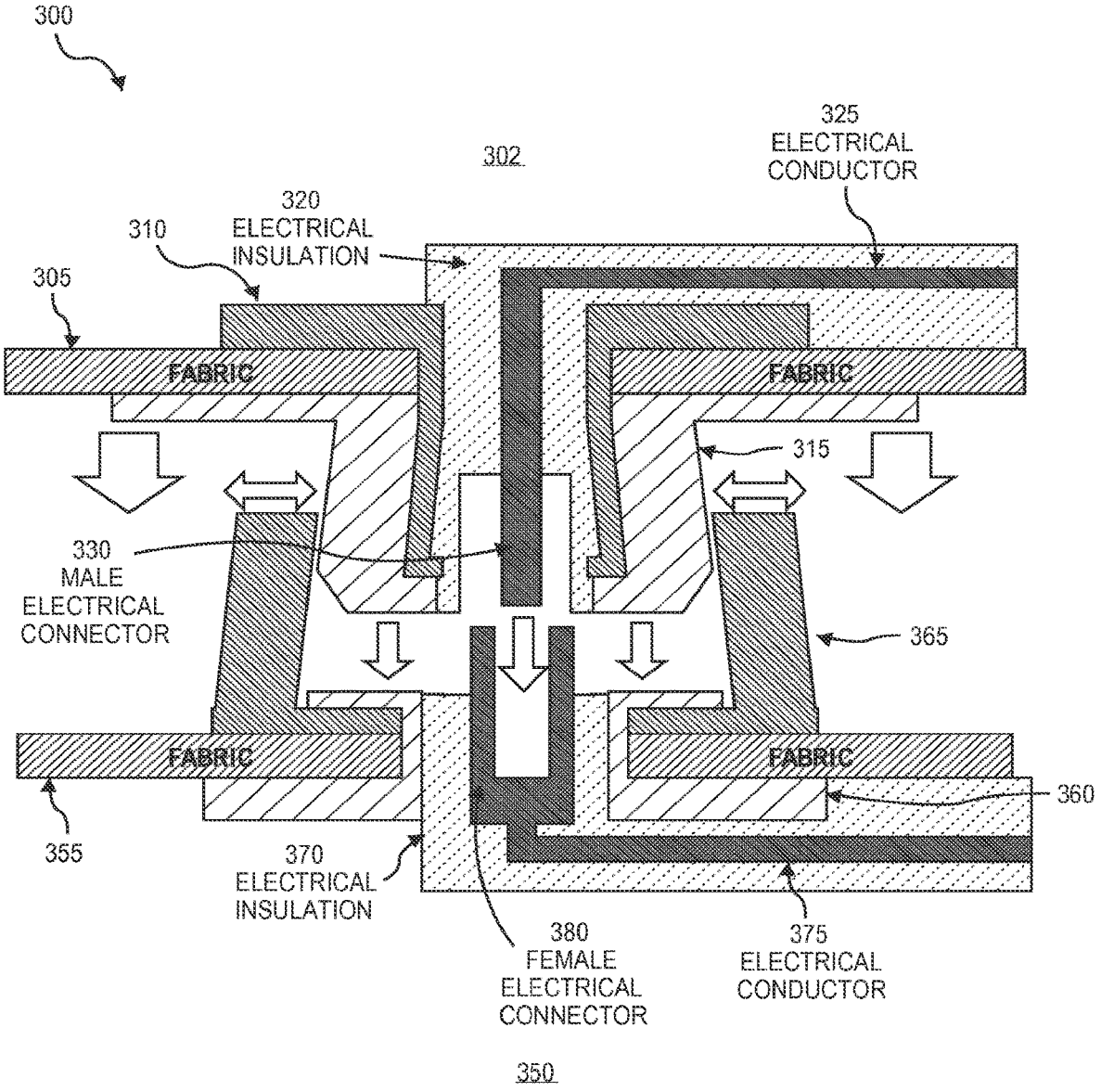
FIG. 3 is an illustration of components of a snap button providing an electrical connection according to an embodiment.

FIG. 3 is an illustration of components of a snap button providing an electrical connection according to an embodiment. As illustrated in the cross-section of an apparatus 300 in FIG. 3, a snap button may include a first mechanical part (male part) 302 to be snapped into a second mechanical part (female part) 350 to removably interlock the first and second mechanical parts. The first mechanical part 302 may be installed in a first portion of fabric or other material 305. The first mechanical part 302 and second mechanical part 350 may be circular in shape along an axis perpendicular to the fabric, but this is not required in all implementations.

In some embodiments, the first mechanical part 302 of the snap button fastener includes multiple sub-parts are that installed together to form the first mechanical part 302, such as, for example, a first sub-part 310 that forms a surface on one side of the fabric 305 and extends through a hole in the fabric 305 and a second sub-part 315 that encloses the portion of the first sub-part 310 that extends through the fabric and forms the stud shape of the first mechanical part 302. As can be seen from the cross-section of the apparatus, the second sub-part 315 has at least a portion with an angle such that the plug shape is larger further away from the fabric that the plug shape is near to the fabric.

In some embodiments, the first mechanical part 302 further includes an element to provide an electrical connection with the second mechanical part 350. In some embodiments, the first mechanical part 302 includes a first electrical connector 330 at least in part within the stud portion of the part. In some embodiments, the first electrical connector is electrically connected to a wire for power distribution, distribution of electrical signals for data transfer, or both, wherein the wire may be an insulated wire including an electrical conductor 325 to carry power or a signal, and electrical insulation 320 to insulate the electrical conductor 325. In an implementation, a first electrical connector 330 may be electrically connected to the electrical conductor 325. In some embodiments, the first electrical connector 330 is one of an electrical pin (a male electrical connector as shown in FIG. 3) or an electrical receptacle (a female electrical connector). However, embodiments are not limited to units in which a separate electrical connector is included at least in part within a mechanical part, and may include a mechanical part that provides the electrical connection, including, for example, the snap button illustrated in FIG. 7.

In the illustrated example, the second mechanical part 350 of the snap button fastener may include multiple sub-parts are that installed together to form the second mechanical part, such as, for example, a first sub-part 360 that forms a surface on one side of the fabric 355 and extends through a hole in the fabric 355 and clamps at least part of a second sub-part 365 that forms the socket portion of the first second mechanical part 350. At least a portion of the second sub-part 365 provides a spring element to be displaced when the stud portion of the first mechanical part 302 is inserted into the socket portion of the second mechanical part 350 and to provide mechanical force to hold the first and second mechanical parts together under a sufficient force along the axis is applied to separate the first and second mechanical part. As can be seen from the cross-section shown in FIG. 3, the second sub-part 365 has at least a portion with an angle such that the receptacle shape is smaller further away from the fabric than the receptacle shape is near to the fabric in order to hold the first mechanical part 302 in place when snapped together.

In some embodiments, the second mechanical part 350 further includes an element to provide an electrical connection with the first mechanical part 302. In some embodiments, the second mechanical part 350 includes a second electrical connector 380 at least in part within the socket portion of the second mechanical part. In an implementation, the second electrical connector is coupled with a wire to transmit power or signals, such as insulated wire including an electrical conductor 375 and electrical insulation 370 to insulate the electrical conductor 375. In some embodiments, the second electrical connector 380 is one of an electrical pin (a male electrical connector) or an electrical receptacle (a female electrical connector, as illustrated in FIG. 3).

In some embodiments in which a snap button part includes an electrical connector that is at least in part within a mechanical part, the electrical connector is centered within the respective snap button mechanical part to provide ease of electrical connection when the parts of the snap button are snapped together.

While for ease of illustration the embodiments provided in FIGS. 3-6 include a single electrical connector in each snap button mechanical part, embodiments are not limited to a single electrical connector, and may include multiple electrical connectors located at least in part within a snap button mechanical part.

Figure 4:
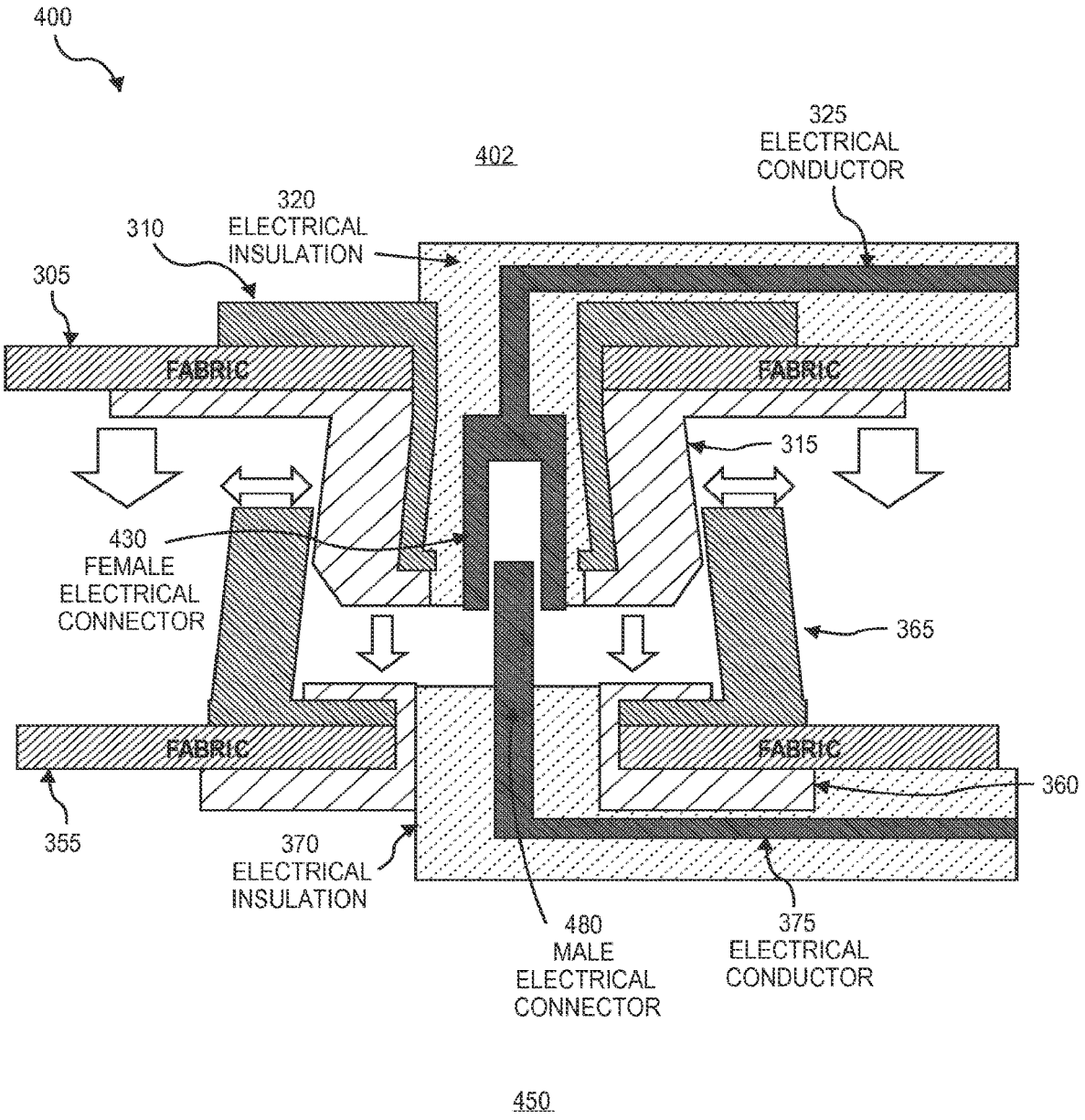
FIG. 4 is an illustration of components of a snap button providing an electrical connection according to an embodiment.

FIG. 4 is an illustration of components of a snap button providing an electrical connection according to an embodiment. As illustrated in the cross-section of an apparatus 400 in FIG. 4, a snap button may include a first mechanical part (male part) 402 to be snapped into a second mechanical part (female part) 450.

As provided in FIG. 4, the components of the first mechanical part 402 and the second mechanical part 450 are the same as illustrated for the first mechanical part 302 and second mechanical part 350 respectively in FIG. 3, except that the first electrical connector 430 of the first mechanical part 402 is a receptacle connector (female connector), and the second electrical connector 480 of the second mechanical part 450 is a pin connector (male connector), thus allowing a reversing of connection parts as required in an implementation. Thus, the embodiment illustrated in FIG. 3 provides a male electrical connector 330 embedded in the male snap button mechanical part 302 and a female connector 380 embedded in the female snap button mechanical part 350, and the embodiment illustrated in FIG. 4 provides a female connector 430 embedded in the male snap button mechanical part 402 and a male electrical connector 480 embedded in the female snap button mechanical part 450.

Figure 5A:
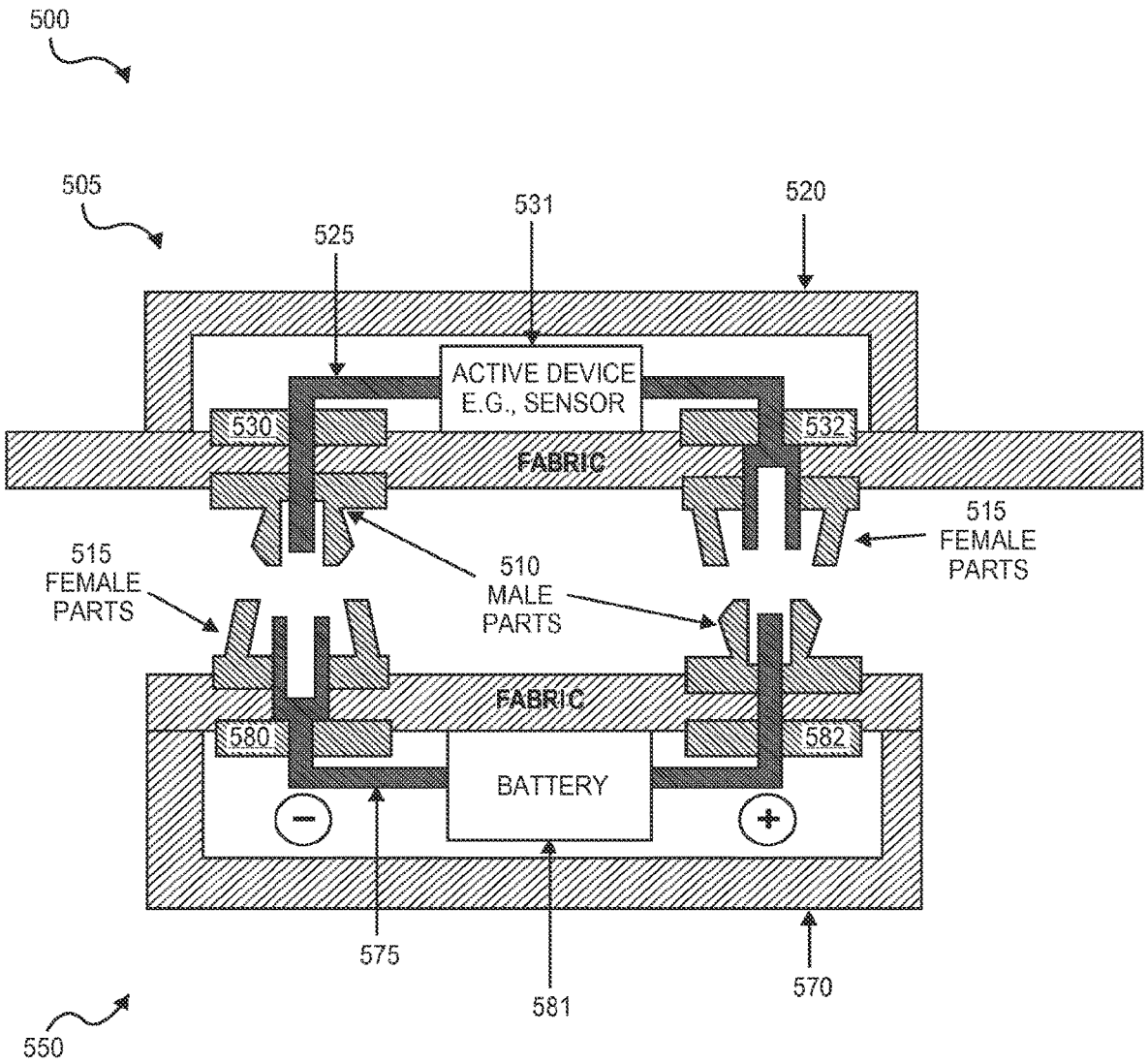
FIGS. 5A and 5B illustrate certain use cases of the snap buttons with electrical connectors in wearable electronics according to an embodiment.
Figure 5B:
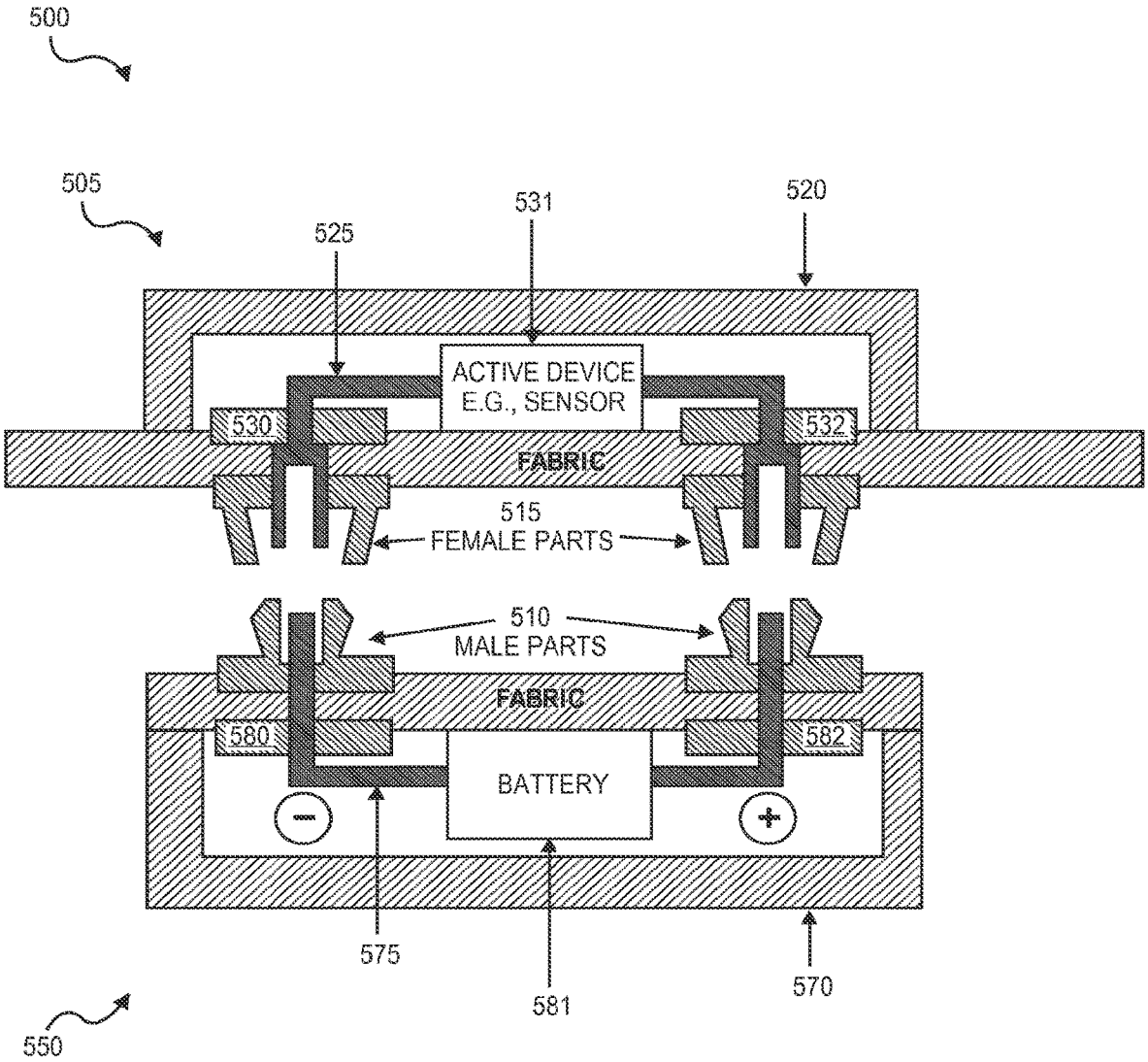

FIGS. 5A and 5B illustrate certain use cases of the snap buttons with electrical connectors in wearable electronics according to an embodiment. In these examples it may be assumed, for example, that the battery of a sensor array in a clothing item is to be detached for a certain process (such as before washing or cleaning the clothing item) and re-attached after the completion of the process (such as after washing or cleaning the clothing item).

As illustrated in FIG. 5A, the wearable electronics 500 may include a first clothing portion 505 including two snap button parts, with a snap button part 530 including a male mechanical part and male electrical connector 510 and a snap button part 532 including a female mechanical part and a female electrical connector 515, the snap button parts 530 and 532 being embedded in fabric 520 and coupled electrically via wires 525 with an active device such as sensor 531.

In some embodiments, the wearable electronics 500 in FIG. 5A may include a second battery pack portion 550 including two snap button parts, with a snap button part 580 including a female mechanical part and female electrical connector 515 and a snap button part 582 including a male mechanical part and a male electrical connector 510, the snap button parts 580 and 582 being embedded in fabric 570 and coupled electrically via wires 575 with a battery 581, a negative terminal of the battery 581 being electrically coupled with the electrical connector of snap button part 580 and a positive terminal of the battery 581 being electrically coupled with the electrical connector of snap button part 582.

In the implementation illustrated in FIG. 5A, the active device (sensor array) 531 is sensitive to the polarity of the battery 581. By proper selection of "male" and "female" mechanical parts (on the clothing portion 505 and the battery pack portion 550) an unintentional interchange by a user of the polarity of the battery can be avoided.

As illustrated in FIG. 5B, the first clothing portion 505 and second battery pack portion 550 of the wearable electronics 500 are unchanged except that that mechanical parts and electrical connectors of the snap button parts are each female 515 for the first portion 505 and are each male 510 for the second portion 550. In the implementation illustrated in FIG. 5B, the active device (sensor array) 531 is not sensitive to the polarity of the battery 581, and thus the same type of mechanical parts can be used on the clothing and the complementary parts can be used on the battery pack.

FIGS. 5A and 5B illustrate a particular example including two snap button parts in each of two portions, but embodiments are not limited to this example, and each portion may include a greater number of snap button parts. In some embodiments, each snap button part of a first portion matches with a respective snap button part of a second portion. In some embodiments, each matching pair of snap button parts provides an electrical connection for power transmission, signal transmission, or both; or a mechanical connection without an electrical connection.

In some embodiments, electrical connectors are insulated against the mechanical parts, which may be helpful especially if the mechanical parts consist of metals. In other embodiments the mechanical parts may consist of insulating materials (such as plastics or other materials), in which case there may be no need for additional insulation. For example, in an implementation utilizing plastic mechanical parts the electrical connectors may simply be embedded by a molding process, applying pressure and heat.

Figure 6:
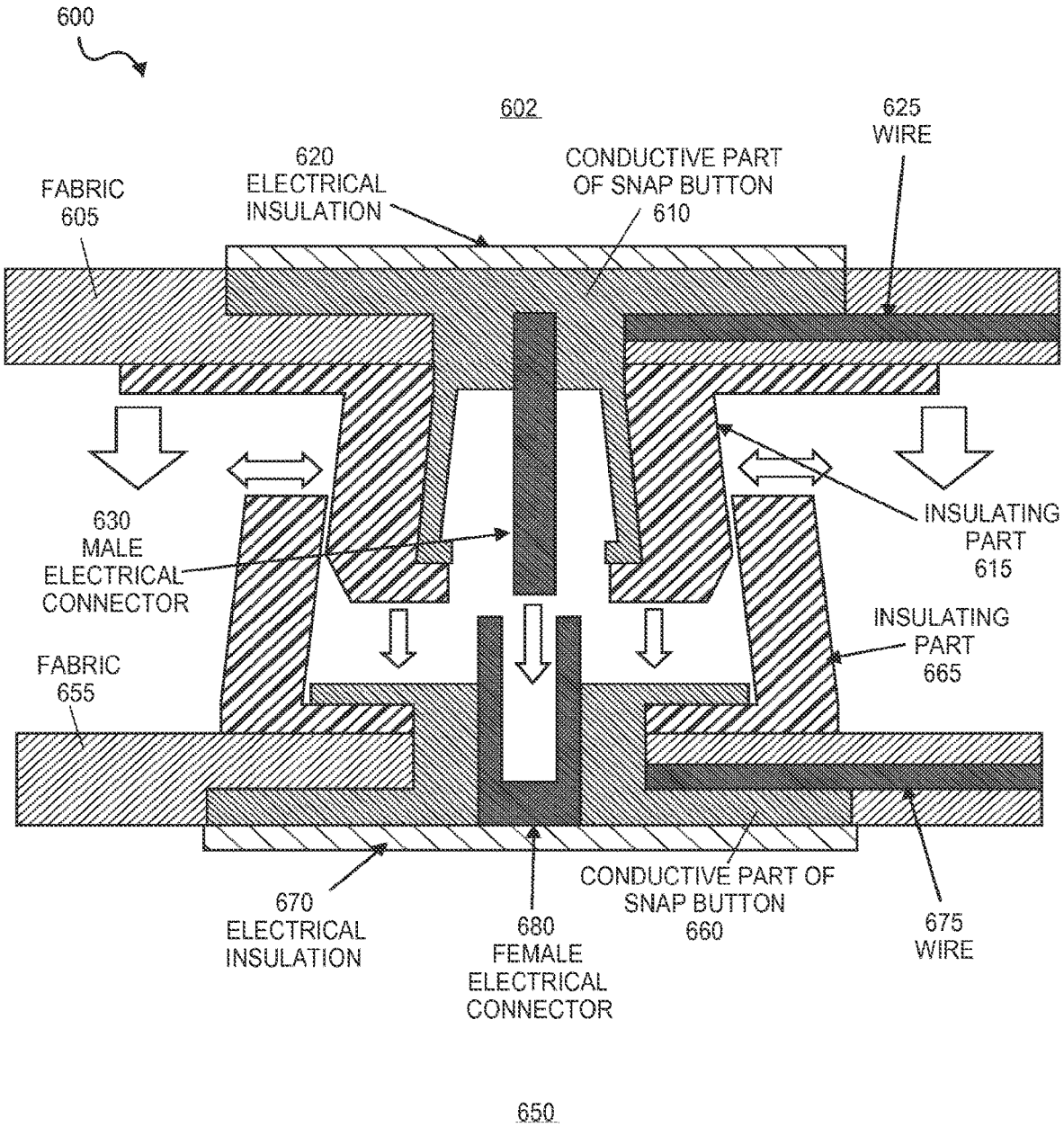
FIG. 6 is an illustration of an apparatus including electrical components that are embedded within fabric according to an embodiment.

FIG. 6 is an illustration of an apparatus including electrical components that are embedded within fabric according to an embodiment. In some embodiments, an apparatus 600 may include the wires, interconnects or contacts for electrical connections that be embedded directly in the respective fabric. In the embodiment illustrated in FIG. 6, the apparatus includes a snap button fastener providing an electrical connection and a wire to conduct power or signs, the fastener and wire being embedded in a fabric.

As illustrated in the cross-section in FIG. 6, a snap button may include a first mechanical part (male part) 602 to be snapped into a second mechanical part (female part) 650. The first mechanical part 602 may be installed in a first portion of fabric or other material 605.

In some embodiments, the first mechanical part 602 of the snap button fastener includes multiple sub-parts are that installed together to form the first mechanical part 602, such as, for example, a first conductive sub-part 610 that forms a surface on one side of the fabric 605 and extends through a hole in the fabric 605 and a second insulating sub-part 615 that encloses the portion of the conductive sub-part 610 that extends through the fabric and forms the stud shape of the first mechanical part 602. In some embodiments, the snap connector may further include electrical insulation 620 on the surface of the conductive sub-part 610 that is opposite to the stud portion of the mechanical part. As can be seen from the cross-section of the apparatus 600, the insulating sub-part 615 has at least a portion with an angle such that the stud portion is larger further away from the fabric than the stud portion near to the fabric.

In some embodiments, the first mechanical part 602 further includes an element to provide an electrical connection with the second mechanical part 650. In some embodiments, the first mechanical part 602 includes a first electrical connector 630 located at least in part within the stud portion of the first mechanical part 602. In some embodiments, the first electrical connector 630 is electrically coupled with the conductive sub-part 610 of the snap button, and the conductive sub-part 610 is electrically coupled with a wire 625 for power distribution, distribution of electrical signals for data transfer, or both, wherein the wire 625 may be an insulated wire. In some embodiments, the wire is embedded in the fabric 605. In some embodiments, the first electrical connector 630, though illustrated in this example as a male electrical connector, may be either a male or female electrical connector.

In some embodiments, the second mechanical part 650 of the snap button fastener may include multiple sub-parts are that installed together to form the second mechanical part, such as, for example, a conductive sub-part 660 that forms a surface on one side of the fabric 655 and extends through a hole in the fabric 655 and clamps at least part of an insulating sub-part 665 that forms the socket portion of the second mechanical part 650. At least a portion of the insulating sub-part 665 provides a spring element to be displaced when the stud portion of the first mechanical part 602 is inserted into the socket portion of the second mechanical part 650 and to provide mechanical force to hold the first and second mechanical parts together until a sufficient force along the axis is applied to separate the first and second mechanical part. In some embodiments, the second mechanical part 650 may further include electrical insulation 670 on a surface of the conductive sub-part 660 that is opposite to the socket portion of the mechanical part 650.

In some embodiments, the second mechanical part 650 further includes an element to provide an electrical connection with the first mechanical part 602. In some embodiments, the second mechanical part 650 includes a second electrical connector 680 located at least in part within the socket portion of the second mechanical part 650. In an implementation, the second electrical connector 680 is electrically coupled with the conductive sub-part 660, and the conductive sub-part is electrically coupled with a wire 675 to transmit power, a signal, or both, where the wire 675 may be an insulated wire. In some embodiments, the second electrical connector 680 may be either a male or female electrical connector.

Figure 7:
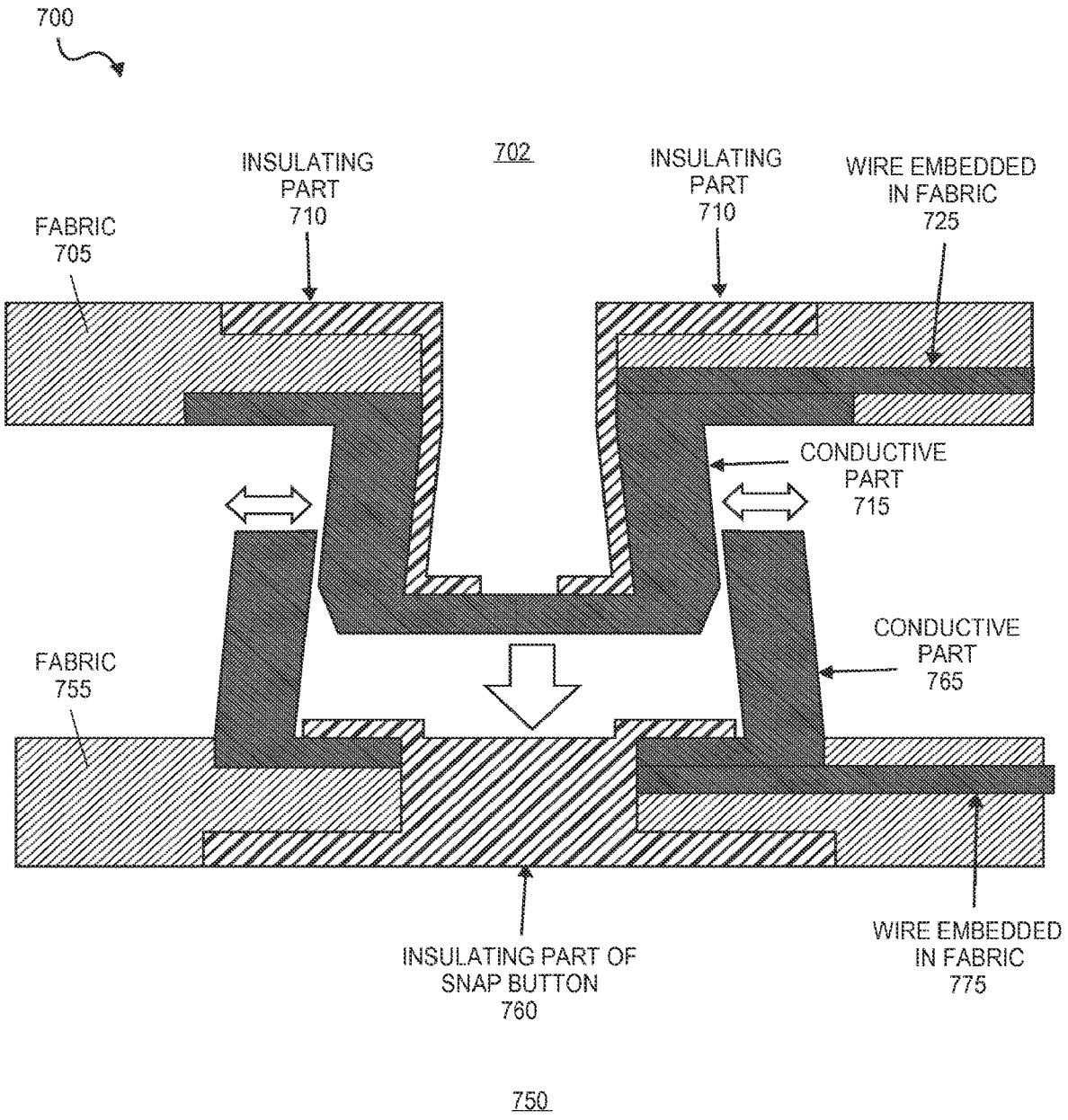
FIG. 7 is an illustration of an article including electrical components that are embedded within fabric according to an embodiment.

FIG. 7 is an illustration of an article including electrical components that are embedded within fabric according to an embodiment. In some embodiments, an apparatus 700 may include the wires, interconnects or contacts for electrical connections that be embedded directly in the respective fabric. In the embodiment illustrated in FIG. 7, the apparatus includes a conductive snap button fastener providing an electrical connection and a wire to transmit power, signals, or both, the fastener and wire being embedded in a fabric.

As illustrated in the cross-section of the apparatus 700 in FIG. 7, a snap button may include a first mechanical part (male part) 702 to be snapped into a second mechanical part (female part) 750. The first mechanical part 702 may be installed in a first portion of fabric or other material 705.

In some embodiments, the first mechanical part 702 of the snap button fastener includes multiple sub-parts are that installed together to form the first mechanical part 702, such as, for example, a first insulating sub-part 710 that forms a surface on one side of the fabric 705 and extends through a hole in the fabric 705 and a second conductive sub-part 715 that encloses the portion of the insulating sub-part 710 that extends through the fabric and forms the stud shape of the first mechanical part 702. As can be seen from the cross-section, the conductive sub-part 715 has at least a portion with a shape such that the stud portion is larger further away from the fabric than the stud portion near to the fabric.

In some embodiments, the conductive sub-part 715 acts as a male electrical connector. In some embodiments, the conductive sub-part 715 is electrically coupled with a wire 725 for power distribution, distribution of electrical signals for data transfer, or both, wherein the wire 725 may be an insulated wire.

In some embodiments, the second mechanical part 750 of the snap button fastener may include multiple sub-parts that are installed together to form the second mechanical part, such as, for example, a insulating sub-part 760 that forms a surface on one side of the fabric 755 and extends through a hole in the fabric 755 and clamps at least part of an conductive sub-part 765 that forms the socket portion of the second mechanical part 750. At least a portion of the conductive sub-part 765 provides a spring element to be displaced when the stud portion of the first mechanical part 702 is inserted into the socket portion of the second mechanical part 750 and to provide mechanical force to hold the first and second mechanical parts together until a sufficient force along the axis is applied to separate the first and second mechanical part.

In some embodiments, the conductive sub-part 765 acts as a female electrical connector. In some embodiments, the conductive sub-part 765 is electrically coupled with a wire 775 for power distribution, distribution of electrical signals for data transfer, or both, wherein the wire 775 may be an insulated wire.

In some embodiments, the fabric 705, 755 is a non-conductive material, but in other embodiments the fabric may be an inherently conductive fabrics. Useful fabrics or drapery may include cotton, denim, linen, silk, synthetics, latex, leather, felt, tarpaulin, plastic foil, rubber foil, or any combination of different fabrics. Inherently conductive fabrics may include metal foils, strips of metal foils or thin metal wires or meshes of thin metal wires embedded in a non-conductive fabric or laminated between synthetic or plastic foils. Other conductive fabrics may include conductive plastic materials or conductive carbon fibers embedded in non-conductive (such as plastic) materials. In some embodiments, the material in which snap buttons are installed is not a fabric. For example, in some instances, thin flexible package substrates may be used in combination with snap buttons with electrical functionality.

It should also be mentioned, that in principle snap buttons with electrical functionality may be combined with snap buttons without electrical functionality on the same fabric. In some embodiments, snap buttons of different size or alternatively different "gender" may be utilized in order to avoid any interchange of electrical and purely mechanical snap buttons. In some embodiments, to avoid any interchange between snap buttons of different functionality (e.g. electrical signal connectors, electrical power connectors, or simple mechanical parts) a specific non-permutable geometric arrangement of the snap buttons may be implemented in an item, where the snap buttons in the item may include any combination of electrical signal connectors of either polarity, electrical power connectors of either polarity, and mechanical connectors without electrical connection. In one example, a wearable electronics item may include a first and second electrical signal connectors that are a first distance apart, a first and second electrical power connectors that are a second distance apart, and a first and second mechanical connectors that are a third distance part, wherein the first, second, and third distance are different. However, embodiments are not limited to this implementation, and may include any non-permutable geometric arrangement of snap buttons.

In some embodiments, electrically functional snap button fasteners may be used not only in clothing, garments, and fashion accessory but also in objects of utility, such as tarpaulin of tents, tarpaulins to cover any goods against environmental effects, and other functional operations.

Figure 8:
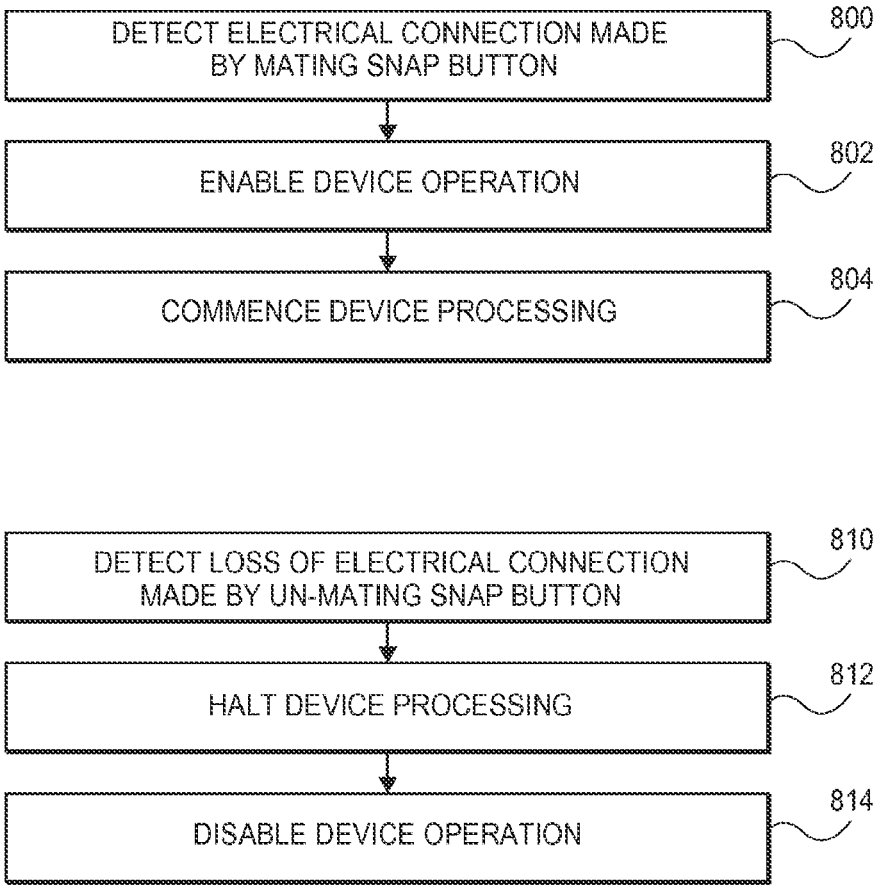
FIG. 8 is a flowchart to illustrate certain operations of an electronic device that includes connection with a snap button according to an embodiment.

FIG. 8 is a flowchart to illustrate certain operations of an electronic device that includes connection with a snap button according to an embodiment. In some embodiments, the electronic device that includes processing capability may detect an electrical connection that is closed by mating the first and second parts of a snap button 800. In some embodiments, the detection of the electrical connection may be detected in any known way, including the detection of a signal from the closed electrical connection. In some embodiments, a device operation may be enabled 802, such as waking the device from a sleep or other low power state, and commencing certain device processing 804, such as processing signals received from a connected sensor.

In some embodiments, the electronic device may detect an electrical connection that is lost by the un-mating of the first and second parts of the snap button 810. In some embodiments, the detection of the loss of the electrical connection may be detected in any known way, including the detection of that a signal is no longer received. In some embodiments, device processing may be halted 812 and device operation is disabled 814, such as placing the device in a sleep or other low power state.

Figure 9:
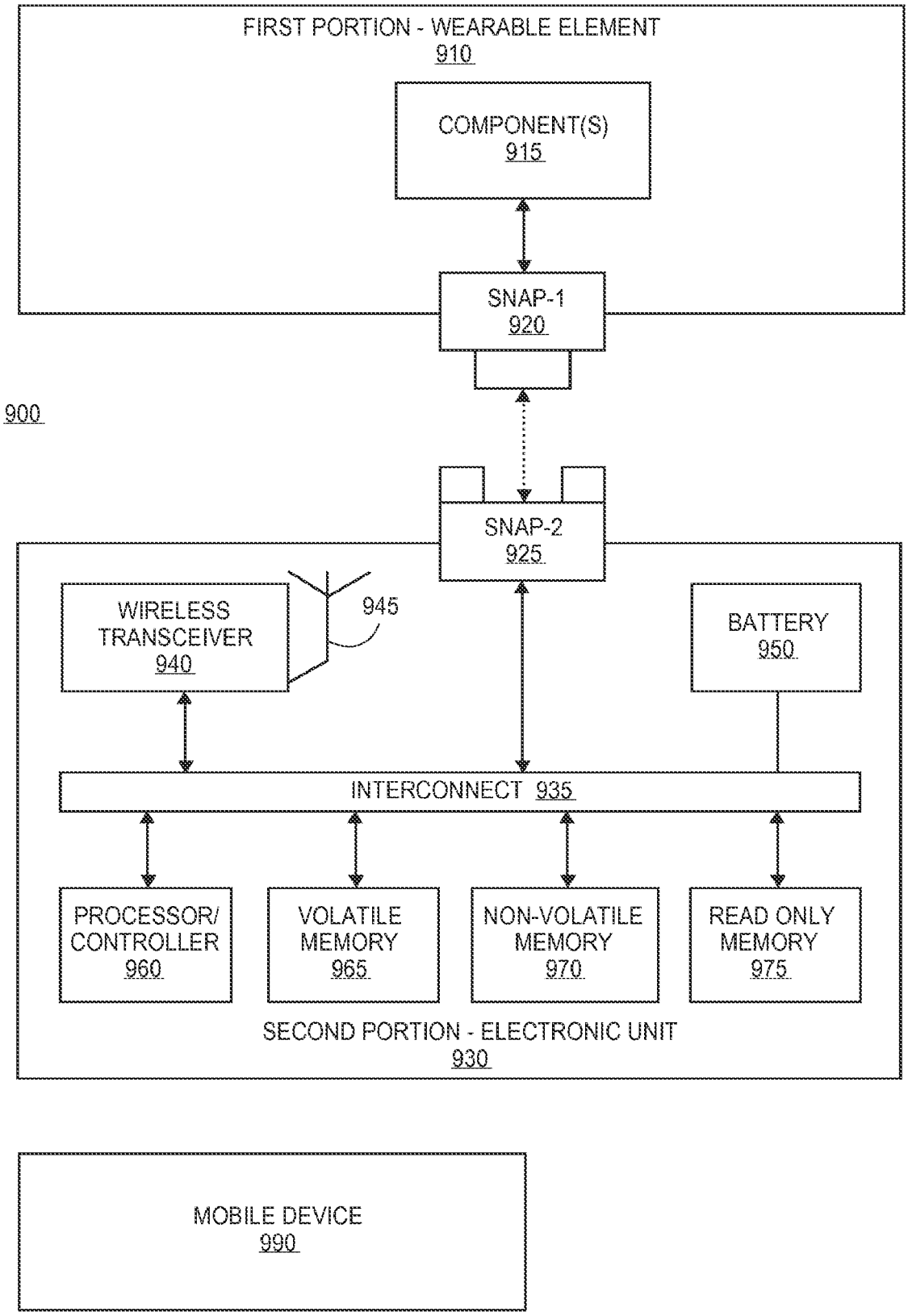
FIG. 9 illustrates a system including connections utilizing snap buttons fasteners providing electrical connections according to an embodiment.

FIG. 9 illustrates a system including connections utilizing snap buttons fasteners providing electrical connections according to an embodiment. In this illustration, certain standard and well-known components that are not germane to the present description are not shown. Elements shown as separate elements may be combined, including, for example, an SoC (System on Chip) combining multiple elements on a single chip.

In some embodiments, a system 900 may include wearable electronics, the wearable electronics including a first portion 910 that is a wearable element and a second portion 930 that is an electronic unit. In some embodiments, the system may optionally include a third element to operate with the wearable, the third element being, for example, an external processing unit, such as mobile device 990, that is connected wirelessly with the wearable electronics.

In some embodiments, the first portion 910 may, for example, include one or more components 915. In some embodiments, components 915 of the first portion 910 are components that either do not require removal from the first portion 910 or cannot practically be removed from such portion. In some embodiments, the one or more components are connected electrically, such as by one or more wires, with a first part of each of one or more snap buttons, such as Snap1 920, which is illustrated as a male mechanical part of the snap button and which includes one of a male or female electrical connector.

In some embodiments, the second portion 930 may, for example, include one or more components. In some embodiments, components of the second portion 930 are components to be removed from the wearable electronics for one or more reasons. In this illustration, the components may include one or more of a wireless transceiver 940 and antenna 945 (such as dipole or other antenna) to communicate with other elements (such a mobile device 990); a battery 950 to provide electrical power; a processor or controller 960 to provide processing or control functions; and one or more memories to store instructions or data, such as volatile memory 965, such as RAM (random access memory), non-volatile memory 970, such as flash memory, and read only memory (ROM) 975. The one or more components are shown as being connected by an interconnect 935, which is representative of one or more buses, wires, and other connections. In some embodiments, the one or more components are connected electrically, such as by one or more wires, with a second part of each of one or more snap buttons, such as Snap2 925, which is illustrated as a female mechanical part of the snap button and which includes one of a male or female electrical connector.

In the description above, for the purposes of explanation, numerous specific details are set forth in order to provide a thorough understanding of the described embodiments. It will be apparent, however, to one skilled in the art that embodiments may be practiced without some of these specific details. In other instances, well-known structures and devices are shown in block diagram form. There may be intermediate structure between illustrated components. The components described or illustrated herein may have additional inputs or outputs that are not illustrated or described.

Various embodiments may include various processes. These processes may be performed by hardware components or may be embodied in computer program or machine-executable instructions, which may be used to cause a general-purpose or special-purpose processor or logic circuits programmed with the instructions to perform the processes. Alternatively, the processes may be performed by a combination of hardware and software.

Portions of various embodiments may be provided as a computer program product, which may include a computer-readable medium having stored thereon computer program instructions, which may be used to program a computer (or other electronic devices) for execution by one or more processors to perform a process according to certain embodiments. The computer-readable medium may include, but is not limited to, magnetic disks, optical disks, compact disk read-only memory (CD-ROM), and magneto-optical disks, read-only memory (ROM), random access memory (RAM), erasable programmable read-only memory (EPROM), electrically-erasable programmable read-only memory (EEPROM), magnet or optical cards, flash memory, or other type of computer-readable medium suitable for storing electronic instructions. Moreover, embodiments may also be downloaded as a computer program product, wherein the program may be transferred from a remote computer to a requesting computer.

Many of the methods are described in their most basic form, but processes can be added to or deleted from any of the methods and information can be added or subtracted from any of the described messages without departing from the basic scope of the present embodiments. It will be apparent to those skilled in the art that many further modifications and adaptations can be made. The particular embodiments are not provided to limit the concept but to illustrate it. The scope of the embodiments is not to be determined by the specific examples provided above but only by the claims below.

If it is said that an element "A" is coupled to or with element "B," element A may be directly coupled to element B or be indirectly coupled through, for example, element C. When the specification or claims state that a component, feature, structure, process, or characteristic A "causes" a component, feature, structure, process, or characteristic B, it means that "A" is at least a partial cause of "B" but that there may also be at least one other component, feature, structure, process, or characteristic that assists in causing "B." If the specification indicates that a component, feature, structure, process, or characteristic "may", "might", or "could" be included, that particular component, feature, structure, process, or characteristic is not required to be included. If the specification or claim refers to "a" or "an" element, this does not mean there is only one of the described elements.

An embodiment is an implementation or example. Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. It should be appreciated that in the foregoing description of exemplary embodiments, various features are sometimes grouped together in a single embodiment, figure, or description thereof for the purpose of streamlining the disclosure and aiding in the understanding of one or more of the various novel aspects. This method of disclosure, however, is not to be interpreted as reflecting an intention that the claimed embodiments requires more features than are expressly recited in each claim. Rather, as the following claims reflect, novel aspects lie in less than all features of a single foregoing disclosed embodiment. Thus, the claims are hereby expressly incorporated into this description, with each claim standing on its own as a separate embodiment.

In some embodiments, a fastener includes: a first mechanical part, the first mechanical part including at least a stud portion, the first mechanical part including a first electrical connector; a second mechanical part, the second mechanical part including at least a socket portion with a spring element and the socket portion, the second mechanical part including a second electrical connector. The stud portion of the first mechanical part and the socket portion of second mechanical part, if separated, are to interlock upon the application of a first force towards each other, and, if interlocked, are to separate upon the application of a second force away from each other. The first electrical connector and the second electrical connector are to be electrically connected when the first mechanical part and the second mechanical part are interlocked, and wherein first electrical connector and the second electrical connector are to be disconnected when the first mechanical part and the second mechanical part are separated.

In some embodiments, the fastener is a snap button fastener.

In some embodiments, the first electrical connector is to be coupled with a first conductor and the second electrical connector is to be coupled with a second conductor.

In some embodiments, the first electrical connector is located at least in part within the stud portion of the first mechanical part and the second electrical connector is located at least in part within the socket portion of the second mechanical part.

In some embodiments, the first electrical connector is either of a male electrical connector or a female electrical connector, and wherein the second electrical connector is the other of a male electrical connector or a female electrical connector.

In some embodiments, each of the first mechanical part and the second mechanical part includes multiple sub-parts.

In some embodiments, the first mechanical part is to operate as the first electrical connector and the second mechanical part is to operate as the second electrical connector.

In some embodiments, the first mechanical part includes an insulating sub-part and a conductive sub-part. In some embodiments, the first mechanical part includes a stud portion, an outside of the stud portion including at least a part of the conductive sub-part. In some embodiments, the first mechanical part includes a socket portion, the socket portion including at least a part of the conductive sub-part.

In some embodiments, the first electrical connector and second electrical connector are to provide for the transmission of power, electrical signals, or both when electrically connected.

In some embodiments, an apparatus includes: a first material; and a first snap button fastener part embedded in the first material, the first snap button fastener including: a first mechanical part to removably interlock with a second mechanical part, and a first electrical connector to provide an electrical connection with a second electrical connector when the first mechanical part is interlocked with the second mechanical part.

In some embodiments, an apparatus further includes a first electrical conductor, a first end of the first electrical conductor being electrically coupled with the first electrical connector, and a first electronic element, a second end of the first electrical conductor being electrically coupled with the first electronic component.

In some embodiments, first electrical connector is located at least in part within a stud portion or socket portion of the first mechanical part.

In some embodiments, the first mechanical part is to operate as the first electrical connector, the mechanical part including a conductive sub-part that is at least a part of the electrical connector.

In some embodiments, the first electrical connector is to provide for the transmission of power, electrical signals, or both when electrically connected with the second electrical connector.

In some embodiments, a wearable electronics item includes: a first portion including a first fabric, and one or more snap button fastener parts embedded in the first fabric, a first snap button fastener part including a first mechanical part and a first electrical connector; a second portion including a second fabric, and one or more snap button fastener parts embedded in the second material, a second snap button fastener part including a second mechanical part to removably interlock with the first mechanical part and a second electrical connector to provide an electrical connection with the first electrical connector upon the first mechanical part being interlocked with the second mechanical part, the electrical connection being broken upon the first mechanical part being separated from the second mechanical part.

In some embodiments, the first portion further includes: a first electrical conductor, a first end of the first electrical conductor being electrically coupled with the first electrical connector, and a first electronic element, a second end of the first electrical conductor being electrically coupled with the first electronic component.

In some embodiments, the first portion further includes a third snap button fastener part including a third mechanical part and a third electrical connector; and the second portion further includes a fourth snap button fastener part including a fourth mechanical part to removably interlock with the third mechanical part and a fourth electrical connector to provide an electrical connection with the third electrical connector upon the first mechanical part being interlocked with the second mechanical part, the electrical connection being broken upon the third mechanical part being separated from the fourth mechanical part.

In some embodiments, the first mechanical part includes either a male or female connector and the second mechanical part includes the other of a male or female connector. In some embodiments, the first mechanical part includes either a male or female connector and the second mechanical part includes the same of a male or female connector.

In some embodiments, the first and second snap button fastener parts are a different size than the third and fourth snap button fastener parts.

In some embodiments, the first portion includes a first set of multiple snap button fastener parts and the second portion includes a second set of multiple snap button fastener parts, each snap button fastener part of the first portion matching with a respective snap button faster part of the second portion.

In some embodiments, each matching pair of snap button fastener parts is to provide one of the following functionalities: an electrical connection for power transmission, signal transmission, or both; or a mechanical connection without an electrical connection.

In some embodiments, the first set of snap button fastener parts and the second set of snap button fastener parts are in a certain non-permutable geometric arrangement to prevent interchange between snap buttons of different functionality.

In some embodiments, the non-permutable geometric arrangement includes a first distance between snap button fastener parts of a first functionality and a second different distance between snap button fastener parts of a second functionality.

In some embodiments, the first electrical connector is located at least in part within a stud portion of the first mechanical part and the second electrical connector is located at least in part within a socket portion of the second mechanical part.

In some embodiments, each of the first mechanical part and the second mechanical part includes a plurality of sub-parts.

In some embodiments, the first mechanical part is to operate as the first electrical connector and the second mechanical part is to operate as the second electrical connector. In some embodiments, each of the first mechanical part and the second mechanical part includes an insulating sub-part and a conductive sub-part. In some embodiments, the first mechanical connector includes a stud portion, an outside of the stud portion including at least a part of the conductive sub-part. In some embodiments, the first mechanical connector includes a socket portion, the socket portion including at least a part of the conductive sub-part.

What is claimed is:

1. An article of manufacture comprising:
- a fabric portion;
- wires integrated with the fabric portion;
- a receptacle carried by the fabric portion, the receptacle defining a cavity;
- a first plurality of electrical conductors accessible in the cavity of the receptacle, the first plurality of electrical conductors in circuit with the wires, the first plurality of electrical conductors below an outer edge of the receptacle; and
- an electronic device including:
  - a wireless transceiver; and
  - a second plurality of electrical conductors, at least a portion of the electronic device to be inserted into the cavity of the receptacle to place the second plurality of electrical conductors in contact with corresponding ones of the first plurality of electrical conductors.

2. The article of manufacture of claim 1, wherein the wires are conductive fibers.

3. The article of manufacture of claim 1, wherein at least one of the first plurality of electrical conductors is a pin.

4. The article of manufacture of claim 1, wherein at least one of the second plurality of electrical conductors is a pin.

5. The article of manufacture of claim 1, wherein the article of manufacture is connected to a jacket.

6. The article of manufacture of claim 5, wherein the fabric portion is denim.

7. The article of manufacture of claim 5, wherein the fabric portion is cotton.

8. The article of manufacture of claim 1, further including mechanical connectors carried by the fabric portion, the mechanical connectors do not have electrical conductors.

9. The article of manufacture of claim 1, wherein the electronic device includes an antenna in circuit with the wireless transceiver.

10. The article of manufacture of claim 9, wherein the wireless transceiver is to communicate with a mobile device via the antenna.

11. The article of manufacture of claim 1, wherein the first plurality of electrical conductors are insulated from the receptacle.

12. The article of manufacture of claim 1, wherein the receptacle includes plastic.

13. The article of manufacture of claim 1, wherein the receptacle has a rounded cross-section.

14. The article of manufacture of claim 1, wherein the electronic device includes a housing.

15. The article of manufacture of claim 14, wherein the wireless transceiver and the second plurality of electrical conductors are carried by the housing.

16. An article of manufacture comprising:

a fabric portion;

wires integrated with the fabric portion;

a receptacle carried by the fabric portion, the receptacle defining a cavity;

a first plurality of electrical conductors accessible in the cavity of the receptacle, the first plurality of electrical conductors in circuit with the wires; and an electronic device including:

a wireless transceiver; and a second plurality of electrical conductors, at least a portion of the electronic device to be inserted into the cavity of the receptacle to place the second plurality of electrical conductors in contact with corresponding ones of the first plurality of electrical conductors; and circuitry to detect an electrical connection between at least one of the first plurality of electrical conductors and at least one of the second plurality of electrical conductors.

17. The article of manufacture of claim 16, wherein the circuitry is to, in response to detecting the electrical connection, wake the electronic device from a low power state.

18. The article of manufacture of claim 17, wherein the circuitry is to detect a loss of the electrical connection.

19. The article of manufacture of claim 18, wherein the circuitry is to place the electronic device in the low power state.

20. An assembly comprising:

a fabric including a plurality of fibers;

wires woven into the fabric;

a receptacle carried by the fabric, the receptacle defining a cavity;

a first plurality of electrical conductors accessible in the cavity below an outer edge of the receptacle, the first plurality of electrical conductors in circuit with the wires; and an electronic device including:

a wireless transceiver; and a second plurality of electrical conductors, at least a portion of the electronic device insertable into the cavity of the receptacle to place the second plurality of electrical conductors in circuit with corresponding ones of the first plurality of electrical conductors.

21. The assembly of claim 20, wherein the wires are conductive fibers.

22. The assembly of claim 20, wherein the fabric is to be joined to a jacket.

23. The assembly of claim 20, wherein the fabric is denim.

24. The assembly of claim 20, further including an antenna in circuit with the wireless transceiver.

25. The assembly of claim 24, wherein the wireless transceiver is to communicate with a mobile device via the antenna.

26. The assembly of claim 20, wherein the first plurality of electrical conductors are insulated from the receptacle.

27. The assembly of claim 20, wherein the receptacle includes plastic.

28. The assembly of claim 20, wherein the receptacle has a rounded cross-section.

* * * * *